United States Patent [19]

Green et al.

[11] Patent Number: 5,048,433

[45] Date of Patent: Sep. 17, 1991

[54] RADIATION ENHANCEMENT IN OIL/COAL BOILERS CONVERTED TO NATURAL GAS

[75] Inventors: Alex E. S. Green, Gainesville; Bruce A. S. Green, Micanopy; John C. Wagner, Gainesville, all of Fla.

[73] Assignee: University of Florida, Gainesville, Fla.

[21] Appl. No.: 581,303

[22] Filed: Sep. 12, 1990

Related U.S. Application Data

[60] Division of Ser. No. 285,818, Dec. 16, 1988, Pat. No. 4,978,367, which is a continuation-in-part of Ser. No. 176,157, Mar. 31, 1988, abandoned.

[51] Int. Cl.[5] ..... F23D 1/02

[52] U.S. Cl. ..... 110/260; 110/264; 110/347

[58] Field of Search ..... 110/347, 264, 265, 260; 431/184

[56] References Cited

U.S. PATENT DOCUMENTS

| | | | |
|---|---|---|---|
| 2,822,864 | 2/1958 | Black | 431/284 X |
| 2,941,585 | 6/1960 | Loebel et al. | 431/284 X |
| 3,124,086 | 3/1964 | Sage et al. | 110/347 X |

*Primary Examiner*—Edward G. Favors

*Attorney, Agent, or Firm*—Kerkam, Stowell, Kondracki & Clarke

[57] ABSTRACT

A coal-gas fuel composition, for use in furnaces and boilers which have been converted from oil or coal to natural gas, an apparatus and a method for burning said composition are disclosed. Conversions of oil or coal designed boilers to natural gas for environmental compliance can lead to an inbalance between radiative and convective heat transfer in the boiler. Co-firing natural gas with specially processed coal slurries can enhance the infrared radiation from the natural gas flame and help restore the balance intended in the original boiler design, without greatly decreasing the environmental performance of the boiler or furnace. Disclosed is a fuel composition comprising optimal ranges and proportions of constituent fuels, including a slurry comprising about 35% micronized additive, such as coal, and 65% No. 2 fuel oil.

6 Claims, 5 Drawing Sheets

RADIATION ENHANCEMENT IN OIL/COAL BOILERS CONVERTED TO NATURAL GAS

BACKGROUND OF THE INVENTION

1. Related Applications

This is a division of application Ser. No. 285,818 filed Dec. 16, 1988, now U.S. Pat. No. 4,978,367, which is a continuation-in-part of application Ser. No. 176,157 filed Mar. 31, 1988, now abandoned.

2. Field of the Invention

This invention relates to methods and apparatus for using a mixture of natural gas and other combustible substances to replace residual oil in existing steam boilers, and more particularly, to providing an enhanced radiation to the primary chamber of a furnace utilizing a mixture of natural gas and other combustible substances in order to increase energy efficiency.

DESCRIPTION OF THE BACKGROUND ART

Energy consumption efficiency has been a subject of continual interest at least since the invention of the stove by Benjamin Franklin. More recently, drastic increases in the prices of oil and other energy sources have focussed attention on obtaining a maximum of energy use efficiency. However, countervailing considerations, such as environmental effects, must be taken into account in developing an energy supply and consumption system. Another major consideration is the cost incurred in the utilization of an energy efficient system, both in procuring a continuous supply of inexpensive fuel and also in the adaptation of existing energy supply systems for greater efficiency with a minimum expenditure. One field in which all of these objectives can be achieved is in converting boilers which were designed in the past for oil consumption when the price of oil was low, but which have become increasingly and prohibitively expensive as oil prices have increased.

Prior to 1970, it was customary to design boilers to optimize efficiency when using the least expensive and most available fuel which, at that time, was oil. Consequently there is a large diversity in the design, size and features of pre-1970 boilers and furnaces. Various fossil fuel boilers with the same power rating would provide for a variety of sizes depending on the type of fuel used and different power ratings were available.

Boilers fired with wood, or those using waste as a fuel, required larger structures and achieved smaller power densities. However, the compact nature of boilers designed for gas fuel use is particularly noteworthy.

Since 1970, federal and local restrictions have made stack emissions an important consideration in fuel selection and hence boiler design. On the other hand, since 1973 the increase in the price of oil from $2/barrel to $12/barrel (the first oil crisis) also became a major factor in fuel selection and boiler design. As a result, few large oil or natural gas boilers have been constructed since the early 1970's.

While the conversion of oil-burning boilers to coal-burning was encouraged, such conversions were generally considered economically unfeasible. Conversions of oil designed power stations to the use of coal were attempted and proved successful economically. However, coal fired furnaces produced a correspondingly greater amount of pollution in the atmosphere, including particulates, as well as $NO_x$ and $SO_2$.

In the United States, environmental regulations and the high capital cost of oil to coal conversions seriously inhibited conversion to coal-burning boilers until the second oil crisis (the 1979 OPEC price increase from about $12/barrel to $32/barrel) stimulated further consideration of converting furnaces and boilers designed for oil to the use of alternative fuels.

To place the practicality of oil to gas conversion in perspective, it should be noted that the United States is greatly and to some extent overburdeningly, dependent on liquid hydrocarbons because of a deeply rooted transportation infrastructure. It will be very difficult and take many years to displace oil based transportation fuels. This, together with the instability of the Middle Eastern oil region, presents a national security and geopolitical "hydrocarbon vulnerability" on the part of the United States.

The United States synthetic fuel program was a major effort to take advantage of and utilize the large solid hydrocarbon resources available in the U.S. to overcome this problem. The proposed Synfuel solution failed in large measure because it is costly to convert coal, which has a hydrogen to carbon ration of about 0.75, ($H/C \sim 0.75$) to transportation fuels ($H/C \sim 2.$). In large part, these high costs are a direct consequence of the thermo-chemical losses in synthetic fuel processes due to the second law of thermodyamics.

Using coal to produce synthetic natural gas ($H/C \sim 4$) to keep pipelines filled faces even greater thermodynamic losses. Here coal must first be used in the steam gasification process to produce syngas ($CO+H_2$). After separating the hydrogen for enrichment purposes, a second reactor uses coal and hydrogen to form methane. The high temperature gas so formed must also be cooled for pipeline shipment. Each of these processes involves thermodynamic losses, and thus they are neither practical nor economically feasible at the present level of oil prices.

A study of the magnitude of losses in synthetic fuel production was recently made. The analysis shows that whereas conversion of crude oil to transportation fuels typically multiplies feedstock costs by a factor of 1.5, the conversion of coal to synfuels typically multiplies coal energy costs by factors from 4 to 8. Under emergency conditions, the synthetic fuel approach may have merit for transportation or military purposes because of the compact storage provided by liquid fuels. However, the synthetic fuel approach appears to have little merit to fill pipelines for utility and industrial uses where the more direct use of coal is possible and economically more expedient.

On the other hand, the coal-water or pulverized coal-gas concepts of coburning coal with gas, two natural domestically available fuels, suffer few of the thermodynamic losses because only physical processes are used. All chemical processes occur directly in the boiler or furnace, thus avoiding heat losses due to conversions outside of the boiler or furnace.

Natural gas is a unique coburning fuel which can serve a variety of purposes by virtue of its (a) large natural abundance (reserves proven and potential of the order of 1000 Tcf), (b) transportation via an extensive pipeline system in North America, (c) large H/C ratio providing a rich source of free radicals, (d) gaseous form, hence immediate readiness for combustion, (e) high heating value, (f) usefulness in foreburning, flame stabilization and flash evaporation, (g) usefulness in afterburning and hot gas cleanup, (h) usefulness in controlling stoichiometry and $NO_x$, (i) absence of $SO_2$, and ability to condition caustic compounds for boiler scrubbing, (j) ability to mitigate greenhouse risk resulting from direct coal burning and (k) ability to make a transportation slurry function as a fuel slurry. By reliance on these unique characteristics, natural gas promotes cleaner and more efficient combustion of many lower quality fuels.

Some unique advantages which derive from fuel conversion and from use of coal/gas mixtures in an industrial oil boiler are (a) minimized power derating, (b) reasonable boiler efficiency and carbon burnout, (c) stable flames over a broad power range, (d) lower $NO_x$ production, (e) and a relatively benign and manageable ash.

Mixtures of coal and gas as well as oil, coal and ethanol have been proposed in the past. For example, U.S. Pat. Nos. 4,561,364 and 4,572,084, issued to at least one of the inventors of the present invention and having a common assignee, relate to a gas-coal combustion method and apparatus which fires a mixture of coal and gas in specified proportions in air, which mixture simulates the energy consumption characteristics of No. 6 fuel oil. Others have proposed a gas fired boiler utilizing a coal-water slurry in a pure oxygen or oxygen-enriched atmosphere.

Coal slurries have also been proposed as transportation fuels. For instance, U.S. Pat. No. 4,469,486, issued to Shah et al. and commonly assigned as the present invention, proposes a fuel oil, pulverized coal and ethanol mixture for use as fuel in an internal combustion engine. All of these proposals have been directed to different aspects of the fuel scarcity problem, and have achieved some success. However, the optimization of a fuel mixture using coal has yet to be addressed in the context of furnaces or boilers.

More recently, coal-water mixtures (CWM) emerged as the most promising alternative to oil in furnaces originally designed for oil burning. This form of coal conversion preserves much of the infrastructure of oil use without increasing air pollution. While such conversions of oil boilers were predicted to lead to substantial power deratings, unexpected properties of coal-water slurry ash helped to overcome those concerns and to dispel these negative predictions.

Another development has been the need to extend plant lifetimes from about 30 years to about 60 years. The need is largely motivated by the high capital costs of utility and industrial construction as well as uncertainties of fuel prices and environmental legislation. Conversion by utility companies of oil-burning boilers to natural gas or dual oil-gas burning capability has proceeded apace. Capital costs of such conversions are low and the environmental and boiler operational improvements are substantial.

These international, political, economic and environmental developments have led to changes in the approach of designing newly manufactured boilers or furnaces. Indeed, dual fuel or multifuel capabilities are emerging as a pattern in new and also in retrofit construction. Fuel blending or fuel coburning in existing boilers or furnaces to meet efficiency goals and environmental regulations may also become an extensive practice. Instead of designing the boiler to fit the fuel, the fuel may be designed to fit the existing boiler by the use of co-combustion.

Thus, boilers having been designed for optimum fuel efficiency using oil as a fuel may be converted by designing the fuel to optimize energy utilization to achieve efficiencies at similar or identical levels when the fuel is a mixture of oil or water and micronized coal.

SUMMARY OF THE INVENTION

Accordingly, it is one object of the present invention to provide for enhanced radiation in a furnace so that an optimum balance may be achieved in the energy derived from the radiant energy portion and from the convection energy portion of a furnace.

It is another object of the present invention to provide for a fuel composition which during combustion, increases flame radiance and has an emissivity curve that in a wavelength range of from about 1 micron to about 10 microns is broader than that of fuels presently known, thus providing a substantially equal amount of energy across the specified range which does not suffer from the spectral emissivity gaps in the spectrum of natural gas flames.

It is yet another object and an important feature of the present invention to provide for a co-combustion fuel mixture for use in boilers or furnaces converted from oil or coal to natural gas where the fuel mixture enhances the radiation energy emanating from the combustion of the natural gas-fuel mixture to provide a greater transfer of radiant energy from the combustion portion of the furnace in the wavelength range from about 1 micron to about 10 microns.

It is yet another object of the present invention to provide for a fuel mixture which enhances the radiation of natural gas combustion in the infrared range so that the amount of energy transfer in that range is optimally efficient for a coal or oil furnace which has been converted to burn natural gas.

It is another object of the present invention to provide a blend of combustible hydrocarbon fuels such as oil, coal and natural gas so that an optimal balance is achieved in the transfer of heat energy between the amount of radiant energy and convective energy used to heat the walls and heat transfer material of the furnace.

It is another object of the present invention to provide maximum fuel consumption efficiency in a converted coal-to-gas or oil-to-gas furnace or boiler which avoids having a disproportionate amount of energy transfer occur through convection rather than by radiation.

Still another object of the present invention is provided in that a furnace or boiler converted from coal or oil to gas consumes fuel which is less expensive than oil, but nevertheless complete combustion takes place so that little or no increase in environmental pollution occurs.

In accordance with these and other objects, features and advantages, there is provided a fuel composition for use in a boiler or furnace comprising a slurry including micronized coal and No. 2 fuel oil for burning together with natural gas, whereby the combustion of the micronized additive with the oil enhances the infrared radiation emanating from the combustion of the natural gas and increases flame radiance so that an optimum balance of energy is transferred from the combustion of fuel as radiant energy and as convective energy.

There is also provided an oil and micronized coal slurry being in proportions adapted to provide an increased flame radiance in the infrared range, the proportions being in a range from 32 to 60 weight percent micronized coal and 40 to 68 weight percent No. 2 fuel oil, optimally with about 2% bentonite or other suspending agent such as organoclays, bentone, soylecithin, calcium naphthanate, lignosulphonates, etc.

These and other objects, features and advantages will become apparent in light of the following detailed description of the invention when understood with particular reference to the drawing figures.

DETAILED DESCRIPTION OF THE INVENTION

The conversion of oil burning furnaces and boilers to other types of fuels has been proposed as a means to diversify the capability of energy supplies and to avoid reliance on uncertain and expensive oil supplies as an energy source. In the energy field, it is considered that utility and large industrial boilers operate on oil about 5% more efficiently than on gas. This figure is mainly based upon the extra moisture content in the stack gases from the higher hydrogen content of natural gas (H/C=4) as compared to oil (No. 6:H/C=1.3, No.2:H/C=1.8). It has been noted that when other losses associated with oil firing are considered, the oil-gas economic balance is much closer. These oil losses include heat loss due to incomplete hydrocarbon combustion products in the flue gas, heat loss due to soot blowing, energy costs for operation of oil heaters, oil pumps, oil atomization, preheating makeup water, costs of fuel oil additives, the additional makeup water and its chemical treatment, and costs associated with corrosion and maintenance and flue gas scrubbing.

Figure 1:
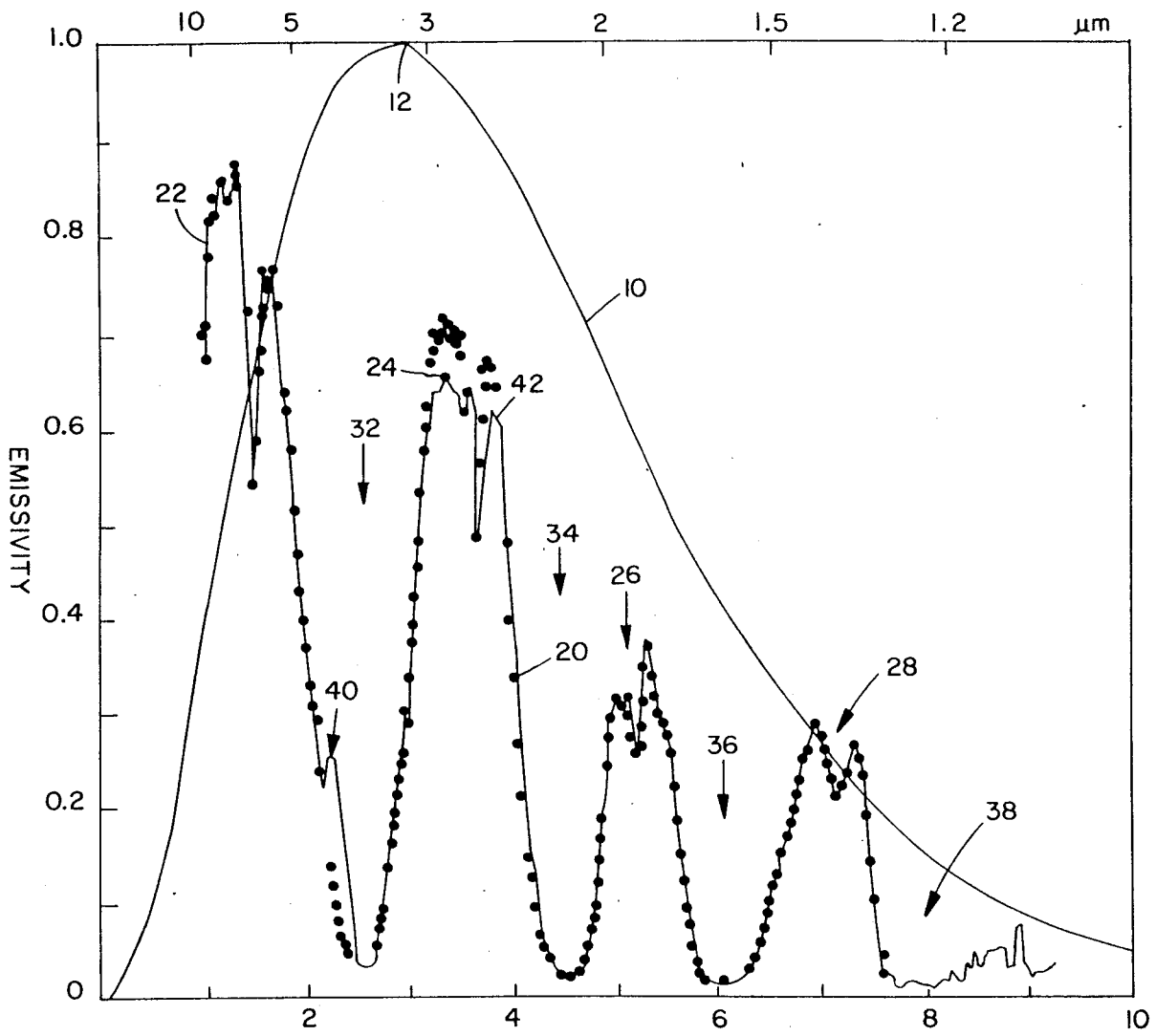
FIG. 1 illustrates in graph form the relationship between spectral emissivity and wavelength and wave number in experimental and calculated values of water vapor at 1500°K. for a 20 foot path length.

Referring now to FIG. 1, illustrated is a graph of the experimental and calculated spectral emissivities for a 20 foot path length of hot steam vapor at 1500° K. The bottom scale is in units of wave number, which is proportional to the reciprocal of the wavelength. The upper scale shows some representative wavelengths in microns. The emissivity values range from 0.0 to 1.0, and represent the percentage or proportion of the maximum calculated value for a black body radiating at 1500° K. The calculated blackbody curve 10 is shown with a peak 12 having an emissivity of 1.0, or 100%.

Curve 20 shows the experimental values for spectral emissivity derived from an experimental set up whereby water vapor is heated up to 1500° K. by methane combustion and the radiation emanating from the water vapor surveyed across a spectral range from about 1.0 to about 10 microns, corresponding to from about 1.0 to about 9.0 wavenumbers, measured in units of $1000cm^{-1}$.

Curve 20 shows highly emissive bands 22, 24, 26 and 28 around $1600cm^{-1}$, $3600cm^{-1}$, $5200cm^{-1}$ and 6900 $cm^{-1}$, respectively, which play the major role in radiant heat and arise from the fundamental and major vibrational overtones of the water molecule.

The gaps 32, 34 and 36 between these bands which lie near $2500cm^{-1}$, $4500cm^{-1}$ and $6200cm^{-1}$, respectively, explain the fact that integrated emissivity of hot water vapor is substantially less than unity. Essentially, the product of this curve 20 and the black body spectrum curve 10, together with complex radiative transfer mechanisms, determines the heat transferred to the water walls of the radiant section of a boiler.

For a methane flame the chemical equation $CH_4+2O_2 \rightarrow CO_2+2H_2O$ determines the reaction products. Thus there is one mole of $CO_2$ for every 2 moles of $H_2O$ in the hot gaseous products of a methane flame. A hot $CO_2$ radiation band 40 near 4.3 microns ($2300cm^{-1}$) narrows the $2500cm^{-1}$ gap 32 in FIG. 1. A 2.7 microns ($4000cm^{-1}$) $CO_2$ band 42 tends to blacken further (increase the emissivity towards 1) the $3600cm^{-1}$ band 24 of $H_2O$. Hot $CO_2$ will have relatively minor effects on the higher bands 26, 28 or band gaps 36 in hot water vapor.

Figure 2:
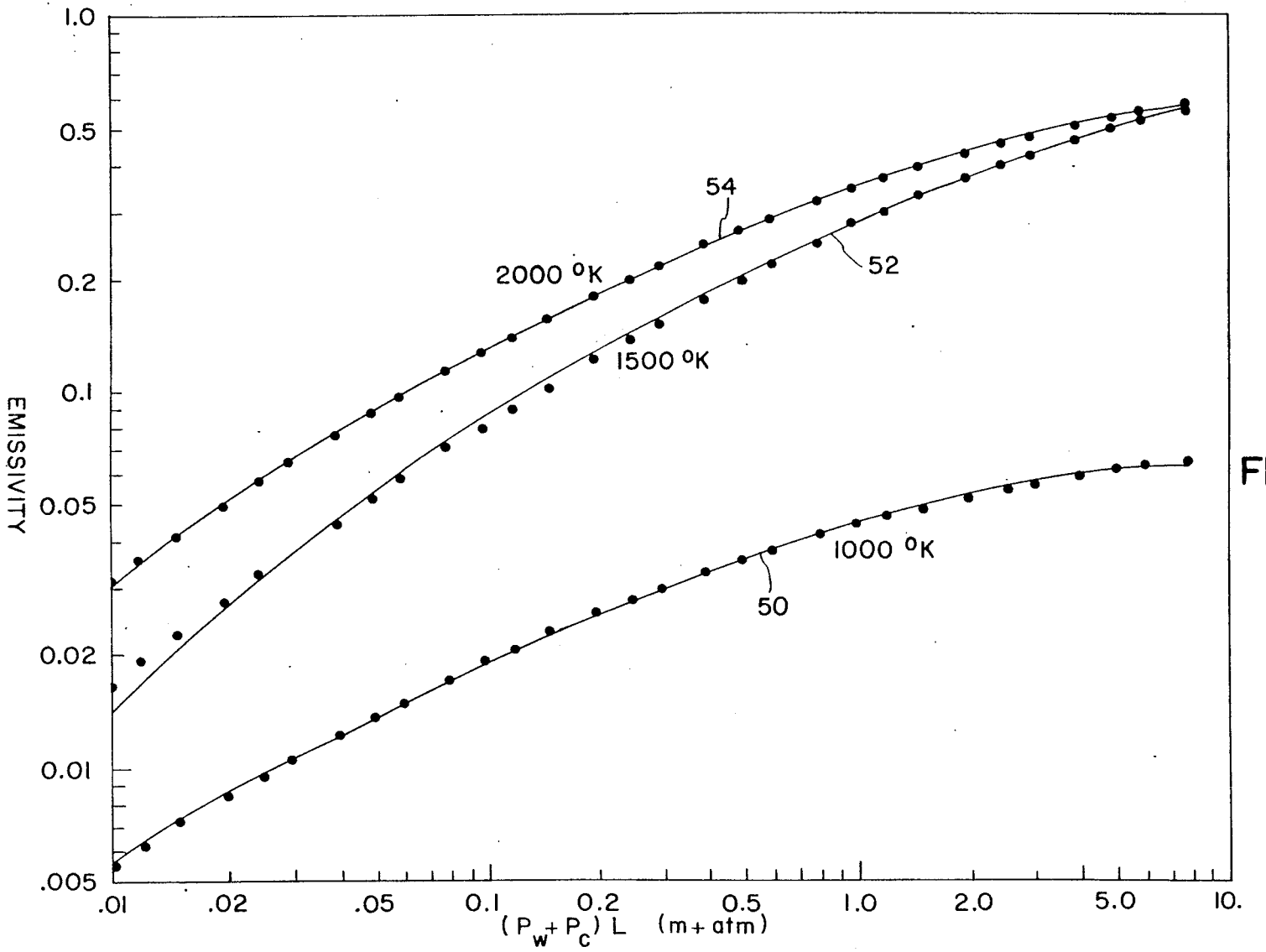
FIG. 2 is a graph of the emissivity of methane flame for various values of the effective path length at three different temperatures.

FIG. 2 illustrates integrated emissivities of a methane flame for various temperatures and effective path lengths. Curves 50, 52, and 54 are based on a model formula, referred to as a "gappiness model," which has been adjusted to an interpolating formula for the three temperatures 1000° K., 1500° K. and 2000° K., respectively. One important conclusion derived from the graph of FIG. 2 is that the infrared band gaps 32, 34, 36, 38 illustrated in FIG. 1 are the primary reason for the fact that the emissivities of natural gas or methane gas flames are much lower than unity. Accordingly, the scientific-engineering solution to improve the radiance of a natural gas flame and to make it more effective in radiant heat transfer in boilers would be to find efficient mechanisms for filling the specific band gaps 32, 34, 36, 38 shown in FIG. 1. The present invention utilizes additives to increase the radiation from the natural gas flame by coburning natural gas and coal particles to obtain efficient radiation enhancement and flame radiance.

The details of furnace construction and our experimental procedures are provided in two technical references, incorporated by reference herein. These are A. Green et al, "Radiation Enhancement by Coal Slurries" *Proceeding* 12th International Conference on Slurry Technology (Mar. 31–Apr. 3, 1987, New Orleans, La., pp. 121–133), and A. Green et al, "Synergisms in Coburning Gas and Coal," 87-JPGC-FACT-10. The structure and details of the laboratory set up are not critical to the use or the teaching of the present invention, but results were obtained which were consistent and which substantiated the concept of enhanced radiation for the radiant energy emanated by the combustion of natural gas together with slurry additives. Details of converted furnace construction are discussed below.

The tables below show the results achieved using two separate and different laboratory setups.

TABLE 1

Results of February 11, 1987 laboratory experiments.

| Type of slurry | gas energy rate KW | oil or slurry energy rate KW | total energy rate KW | part oil or slurry % | Pbs reading V | est. gas Pbs reading V | in-crease % | normed in-crease %/% |
|---|---|---|---|---|---|---|---|---|
| slurry 1, MCWS | 15.82 | 0.86 | 16.69 | 5.2 | 0.602 | 0.587 | 2.6 | 0.50 |
| water only | 15.82 | 0.00 | 15.82 | 0.0 | 0.480 | 0.521 | −7.9 | |
| slurry 2, CCWS | 15.82 | 1.70 | 17.52 | 9.7 | 0.680 | 0.649 | 4.8 | 0.49 |
| slurry 3, MCWS | 15.82 | 1.55 | 17.37 | 8.9 | 0.643 | 0.638 | 0.8 | 0.09 |
| slurry 4, MCOS | 15.22 | 2.44 | 17.66 | 13.8 | 0.850 | 0.659 | 29.0 | 2.10 |
| No. 2 oil only | 15.24 | 4.42 | 19.66 | 22.5 | 0.863 | 0.809 | 6.7 | 0.30 |
| slurry 5, MCOS | 14.29 | 0.83 | 15.13 | 5.5 | 0.550 | 0.471 | 16.8 | 3.04 |
| slurry 6, MCOS | 14.27 | 2.04 | 16.31 | 12.5 | 0.690 | 0.558 | 23.7 | 1.90 |
| slurry 7, CCOS | 14.19 | 1.57 | 15.76 | 10.0 | 0.576 | 0.518 | 11.2 | 1.12 |

Slurry 1 was 50% micronized, 50% water; slurry 2 was 51% coal, 49% water; slurry 3 was 47% micronized coal, 53% water; slurry 4 was 35% micronized coal, 65% No. 2 oil; slurry 5 was 42% micronized coal, 58% oil; slurry 6 was 40% micronized coal, 60% oil; slurry 7 was 47% coal, 53% No. 2 oil.

TABLE 2

Results of June 9, 1987 laboratory experiments.

| Type of slurry | gas energy rate KW | oil or slurry energy rate KW | total energy rate KW | part oil or slurry % | Pbse reading mv | est. gas Pbse reading mv | in-crease % | normed in-crease %/% |
|---|---|---|---|---|---|---|---|---|
| water only | 11.55 | 0.00 | 11.55 | 0.0 | 60.2 | 62.7 | −4.0 | |
| No. 2 oil only | 11.55 | 4.18 | 15.73 | 26.6 | 95.8 | 102.7 | −6.7 | −0.25 |
| No. 2–No. 6 mix | 11.50 | 3.04 | 14.54 | 20.9 | 92.9 | 91.5 | 1.5 | 0.07 |
| slurry 1, CCOS | 11.63 | 1.19 | 12.82 | 9.3 | 81.0 | 74.5 | 8.1 | 0.88 |
| slurry 2, CCOS | 11.51 | 1.51 | 13.02 | 11.6 | 79.5 | 77.0 | 3.2 | 0.28 |
| slurry 3, MCWS | 11.73 | 0.29 | 12.02 | 2.4 | 64.6 | 67.3 | −4.0 | −1.67 |

Slurry 1 was 47% coal, 53% No. 2 oil with 2% bentone; slurry 2, 38% coal, 62% No. 2 oil with 2% bentone; and slurry 3, 38% micronized coal, 62% water.

Tables 1 and 2 show the average results of two sets of laboratory radiation enhancement experiments. Gas-only firings were made throughout the other runs to provide baseline radiation levels. Atomized water alone resulted in a loss in radiation due to the absorption of radiant energy by $H_2O$ molecules. High flow rates of atomized No. 2 oil also showed a loss in radiation per percent of oil energy to total energy input when compared to the estimate of what the radiation would be for gas only. A mixture of No. 2 oil and No. 6 oil averaged no loss or gain in radiation. Coal suspended in No. 2 oil showed the best performance with a micronized coal giving better results than standard pulverized coal. Coal suspended in water, however, indicated a radiation loss.

The conclusion reached for both sets of runs were that coal and No. 2 oil slurries radiate more favorably in the infrared than coal suspended in water. Coal particles, particularly micronized, also radiate better than residual oil suspensions. While the data obtained was somewhat noisy at high flow rates, these experiments clearly indicate examples of efficient additives which strongly enhanced the infrared radiation of natural gas flames to avoid the effects of the radiant energy gaps 32, 34, 36, 38 illustrated in FIG. 1.

The conclusion reached as a result of the experiments was that boiler efficiency increases on the order of 2 to 3% were achieved by using a slurry with optimal proportions over gas flame.

There are also other advantages in utilizing additives with a coal-gas burning furnace which will become increasingly important as a result of projected future developments in the field. A survey of oil boilers which have been or are being converted to natural gas or dual oil-gas firing indicates that there are other considerations besides a few percentage points of boiler efficiency. Furnaces utilizing an oil burning process have been converted to using coal-residual oil slurry. However, residual oil quality has degraded seriously in recent years as a result of distillation process developments yielding increased transportation hydrocarbons from crude oil. Currently used residual oils lead to deposits on the water tube walls used in boilers similar to those in boilers using coal only. Plant operators with dual capability have resorted to pressurized steam cleaning water tube walls to restore boiler efficiency. Frequently, gas used at high load levels leads to high temperatures in the convective sections and to load limitations varying from 95% to as low as 75% of the nameplate oil rating. The likely source of this problem is the low emissivity of natural gas flames resulting in low energy absorption in the radiant section and consequently high temperatures in the convective sections.

It has been determined that the most direct approach to overcoming the problems of the insufficient flame radiance when firing natural gas in oil or coal designed boilers would be using additives to increase the flame radiance. The radiation enhancement achievable by adding slurries to natural gas flames compensates for boiler efficiency losses due to high water vapor in stack emissions. At high load levels radiant slurry additives could restore the radiative-convective heat transfer balance which could be upset in oil to gas or coal to gas conversions. When using natural gas with tailored coal slurry additives for radiative enhancement purposes, the cost of the slurry is not a critical factor and hence highly beneficiated micronized coal slurries could be used so as to reduce the amount of ashes resulting from the burning process.

The inventive system can also alleviate environmental problems associated with coal furnaces such as ash, particulate and sulfur dioxide emission problems. In coal to gas conversions, which are sometimes necessary for emission compliance in urban areas, the coal capability of the boiler itself would accommodate bottom ash and fly ash and a moderately beneficiated coal slurry should suffice to overcome these problems. Highly beneficiated micronized coal slurries will, of course, be even freer of ash and $SO_2$ problems.

From the standpoint of radiative heat transfer, the combustion products of $H_2O$ and $CO_2$ are the two most important gaseous species obtained from hydrocarbon combustion. To predict hot gas emissivities and absorptivities, it is now necessary to make many engineering compromises, despite the massive background literature on gaseous flame radiation. The effect of particulates in gaseous flames have received much less attention, although many studies have been carried out on the influence of soot particles on flame radiance. However, the scientific literature on the influence of coal particles or coal slurry droplets is not overly extensive. Because of the greater complexity of this problem, the ability to accurately predict radiation enhancement is quite limited.

Various flame radiation mechanisms which may play a role in radiation enhancement of natural gas flames were studied, including chemiluminescence, molecular emission, thermal particle emission and multiple Mie scattering. It is known that coal flames and oil flames are much more luminous than natural gas flames. However, the appearance to the human eye, which is sensitive to radiations worth wavelengths from 0.38 microns (violet) to 0.72 microns (red), does not provide a good indication of radiant energy transfer. Radiant heat transfer in boilers takes place primarily through infrared radiations between 1 to 10 microns, where visible emissions are relatively unimportant.

Experiments leading up to one aspect of the present invention have developed that co-burning natural gas with a small percentage of coal slurry (GCS) tailored by the addition of radiation enhancers aid in conversions from oil to gas or coal to gas. Thus radiation enhancement of natural gas flames by coal slurry additives can help overcome practical problems in boiler operations, and especially in boiler conversions by inexpensive and readily available means. Several examples in which small quantities of coal greatly enhance the radiative output of natural gas flames have been developed. When these examples are considered in the context of our theoretical discussions, it appears that the $H_2O$ - $CO_2$ spectra emissivity band gaps 32, 34, 36, 38 of FIG. 1 have been blackened. Thus, these slurries improve the radiative transfer in the radiant section of an oil or coal boiler and help restore the balance intended in the original boiler design.

Figure 3:
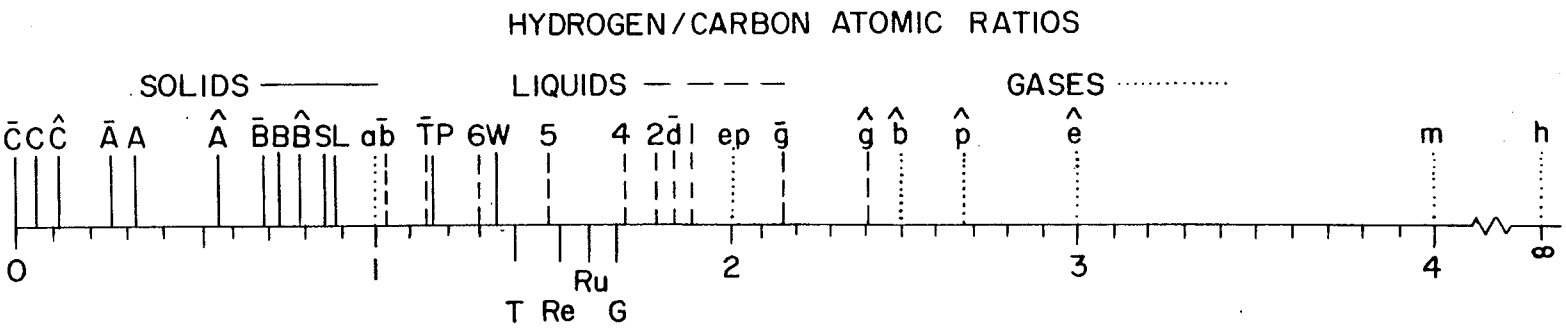
FIG. 3 illustrates the Hydrogen/Carbon atomic ratios for various solid, liquid and gaseous hydrocarbons in linear graph form.

Referring now to FIG. 3, Hydrogen to Carbon atomic ratios for various solid, liquid and gasous hydrocarbons are shown. The symbols denote the following: $\bar{C}$ - Carbon, C - Petroleum coke, $\hat{C}$ - Coal Coke, $\bar{A}$ - Meta anthracite, A - Anthracite, $\hat{A}$ - Semianthracite, $\bar{B}$ - Low volatile bituminous, B - Medium volatile bituminous, $\hat{B}$ - High volatile bituminous, S - Subbituminous, L - Lignite, a - Acetylene, $\bar{b}$ - Benzene, $\bar{T}$ - Toluene, P - Peat, 6 - No. 6 oil, W - Wood, 5 - No. 5 oil, 4 - No. 4 oil, 2 - No. 2 oil, d - Diesel oil, 1 - No. 1 oil, e - Ethylene, $\bar{g}$ - Gasoline, p - Propylene, $\hat{g}$ - Natural gasoline, $\bar{b}$ - Butane, $\hat{p}$ - Propane, $\hat{e}$ - Ethane, m - Methane, h - Hydrogen. These ratio values are only representative, as actual hydrocarbon liquids and solids have a variety of ranges of H/C ratios.

As can be seen from the graph, a mixture of coal and natural gas would tend to average to a hydrogen to carbon ratio in the approximate range of oil ($\sim$1.5) depending on the proportions of coal and natural gas used.

Figure 4A:
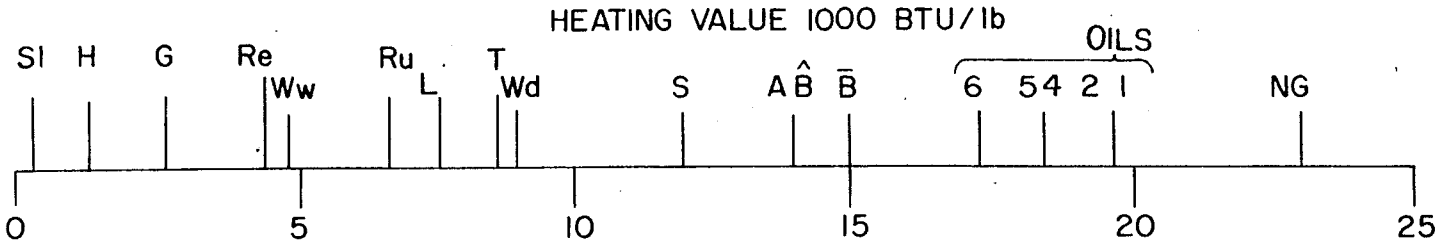
FIG. 4A illustrates the heating value of some commonly used fuels in linear graph form.
Figure 4B:
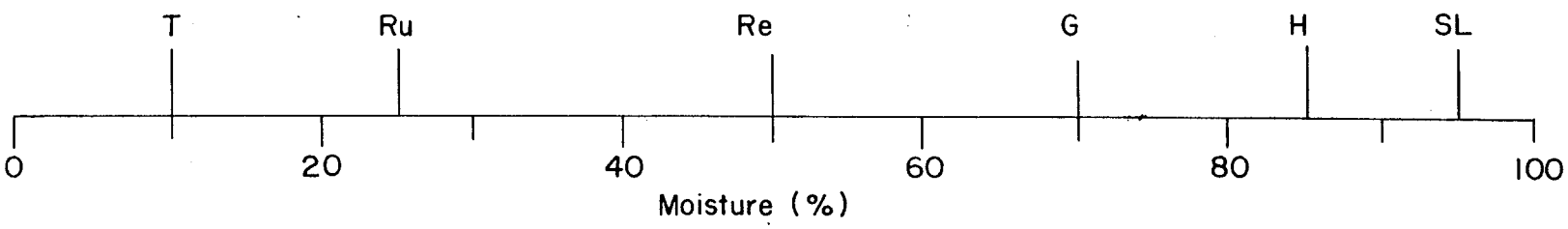
FIG. 4B shows in linear graph form the percentage of moisture content for selected waste products.

The graph of FIG. 3 also shows the approximate H/C ratios of some commonly proposed alternative fuels. In FIGS. 3 and 4A-B, T represents trash, Re - refuse, Ru - rubbish, G - garbage and Sl - sludge.

FIG. 4A illustrates the heating value of various fuels measured in 1000 BTU/b. The symbols used in FIG. 3 are identical to those used in FIGS. 4A and 4B with the addition of the following: H - Human and animal remains, Ww - Wet wood, Wd - Dry wood, and NG - Natural gas. In FIG. 4A, it can again be seen how a mixture of natural gas and coal would average to a value in the range of the fuel oils.

FIG. 4B illustrates the percentage of moisture content in some commonly utilized alternative fuels. It should be noted that increased moisture content correlates with lower heating values and decreases the emissivity and thus the flame radiance of the natural gas flame.

Figure 5:
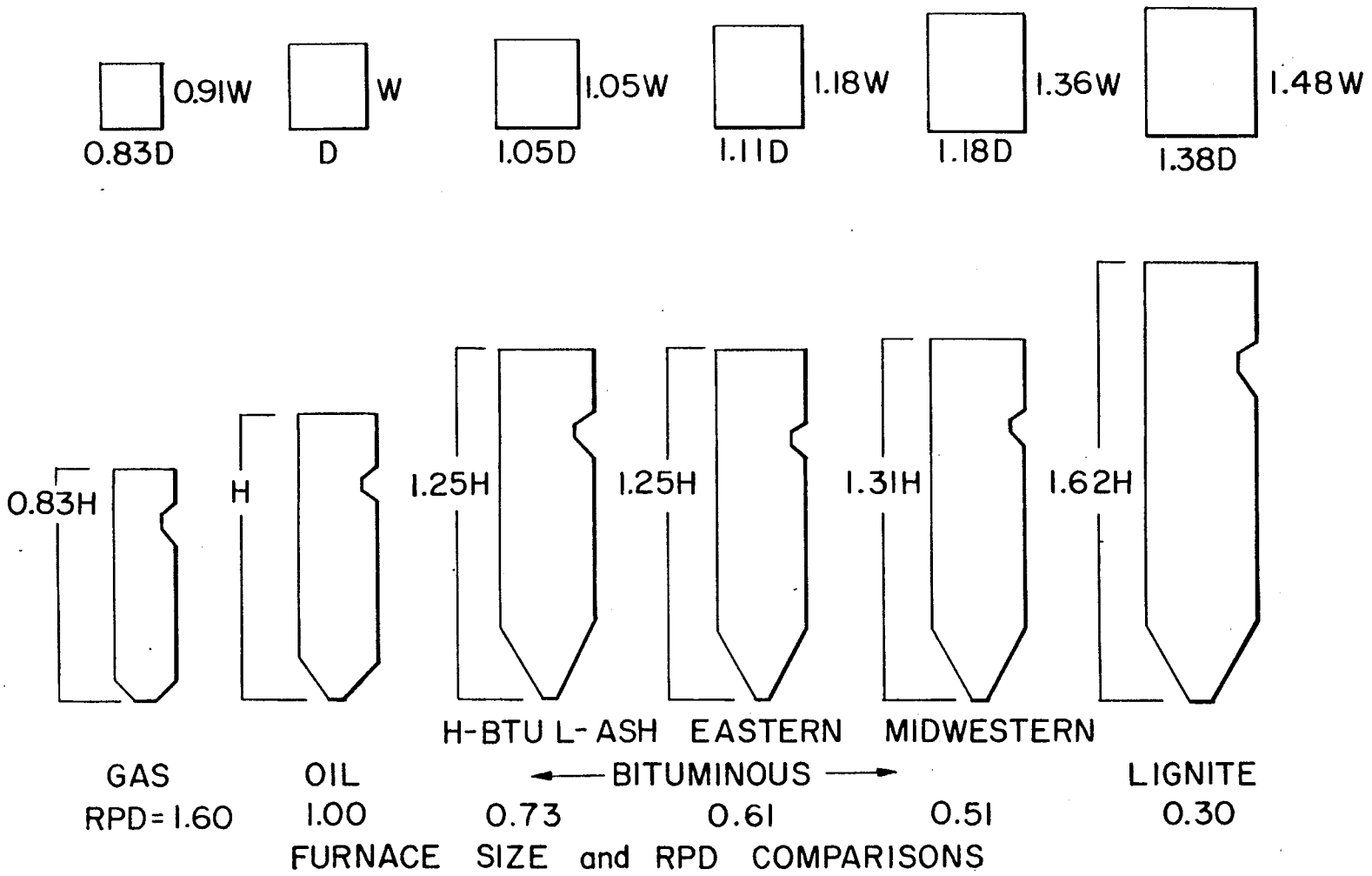
FIG. 5 illustrates the relationship between furnace sizes and relative power densities depending on the type of fuel used.

FIG. 5 illustrates the relationship between the type of fuel and the sizes of furnaces used, along with each of their relative power densities (RPD). Again, it should be obvious that a coal-gas or coal-oil-gas mixture could provide an average sized oil furnace with average power density so as to make the furnace efficient for use with a blended fuel.

Tables 1 and 2, above, illustrate the efficiencies developed through experimentation in a furnace utilizing various oil-micronized coal slurries as well as known fuels. Using natural gas as a standard, the conclusions reached were that a gas-coal slurry (GCS) blend in which the coal slurry serves to enhance the radiative output of the gas flame and restores the radiative-convective balance of the original oil or coal designed boiler shows an increased efficiency.

Moreover, where the slurry contained a mixture of from about 32 to about 60 weight% micronized coal and from about 40 to about 68 weight% No. 2 fuel, increases in furnace power efficiency increased on the order of about 3%.

Micronized coal is coal which has been reduced in size so that almost all of the particulates being in a range of from about 1 to about 50 microns. A slurry is achieved by blending the micronized coal in a suspension of either water or oil. No. 2 or No. 6 fuel oil, or a combination of these oils, have been tested in the slurry. The slurries of Table 2 have used No. 2 oil with 2% bentonite additive which acts as a suspending agent and provides some beneficial characteristics for radiation enhancement.

As the tables show, the best results are achieved using slurry proportions of 35% micronized coal and 65% No. 2 oil, (Table 1, slurry 4). It is considered that an increase in the price of oil will make the use of the present invention economically viable, but in any case, conversion of oil furnaces to coal-gas firing will eventually be necessitated by depleting domestic oil supplies. Furthermore, the furnaces in which the fuel oil is contemplated for use can be adapted to use the cheapest, cleanest or most readily available combination of fuels, depending on the circumstances and economic and societal conditions.

Figure 6:
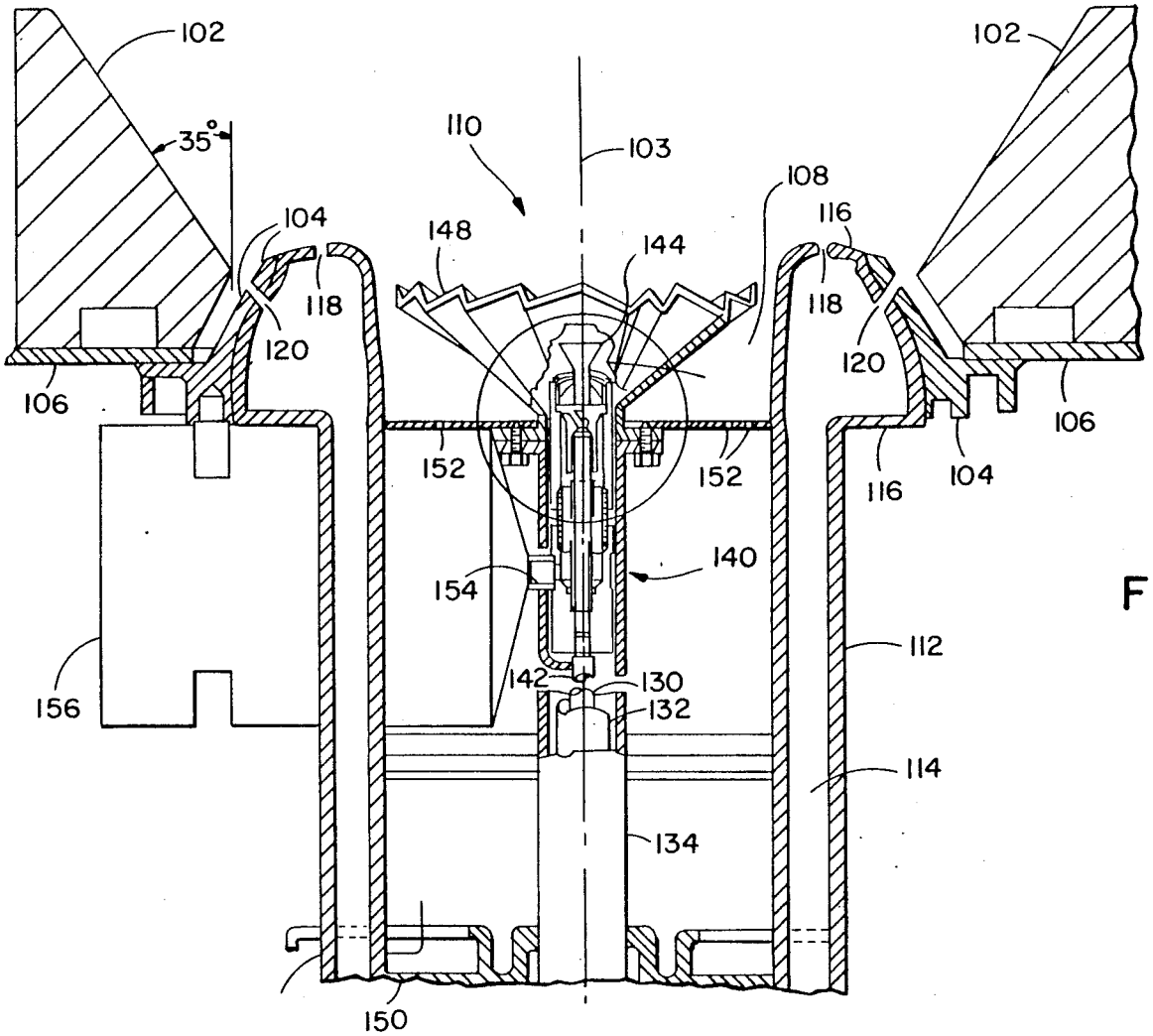
FIG. 6 illustrates in cut-away cross-section an embodiment of an atomizer-burner which can be used to atomize the slurry, blend the atomized slurry with natural gas and burn both fuels together.

FIG. 6 illustrates in cut-away cross-section an embodiment of the atomizer-burner of the invention which is used for co-combusting the slurry with natural gas in order to obtain the enhanced radiation capabilities of the slurry mixture. The combustion chamber, or radiant portion of the furnace, is shown at 100, and is enclosed by furnace walls 102 which are at an angle of approximately 35° to a centerline 103 of the burner. Fixtures 104, 106 are connected to the furnace wall 102 and create a seal between the wall 102 and the gas ring indicated at 110. Walls 102 and fixtures 104, 106 may be circular or polygonal around centerline 103, and they may comprise a good insulating material such as fired brick or ceramic, and provide for an opening 108 for connection to the atomizer-burner, generally indicated at 110.

Atomizer-burner 110 comprises two separate fuel introduction means for injecting natural gas and slurry into the combustion chamber. Gas inlets 112 comprise gas inlet tubes 114 which provide a means for the natural gas to enter the combustion chamber 100. Gas rings 116 forms a torus or semi-circular shape at the termination of gas inlet tubes 112 which plug the opening 108 formed in the combustion chamber 100. Gas rings 116 have openings 118, 120 for the natural gas to escape into combustion chamber 100. Central gas opening 118 provides for a central gas jet and outer gas opening 120 provides for an outer gas jet in the chamber along wall 102. Openings 105 in fixture 104 provides a complete path for the outer gas jet to enter the combustion chamber, where it can burn.

The slurry enters the combustion area through insulated slurry pipe 130, shown in cut-away view. Insulation 132 around slurry pipe 130 provides a means to isolate the slurry pipe 130 from the air, and insulation pipe 134 surrounds both slurry pipe 130 and atomizer 140. It is necessary to isolate the joint between atomizer 140 and slurry pipe 130 in order to guard against unwanted combustion in the premixing stages of the burner.

Slurry pipe 130 connects to atomizer 140 through the atomizer slurry inlet 142, and provides a continuous stream of slurry to the atomizer 140 from a slurry reservoir (not shown). Atomizer 140 may be a conventional atomizer, for instance, a Parker-Hannifin atomizer, which is further adapted for the purpose of the present invention.

Adapting a conventional atomizer to create a slurry atomization pattern with a wide plume to match the natural gas jet flame in the combustion chamber 100 is achieved by attaching a pintel 144 to the atomizer output aperture 146. A swirler 148 provides for a gas flow pattern which together with the central and outer gas jet flows create a vortex of atomized slurry droplets and particles within the natural gas jet flame for more complete burning of all the fuels in the blend.

Oxygen is provided for the combustion process by aspirating air through a wind box 150 from the atmosphere along the path of the arrow. The air can then flow into the combustion chamber at appropriate inlets 152. Air is also provided to the atomizer 140 through air nozzle 154 under pressure by means of air duct 156 which atomizes and sprays the slurry into the combustion chamber 100 for cleaner burning of the fuels. A more thorough discussion of the processes of swirling particulate and droplet fuel within a gas flame may be found in U.S. Pat. Nos. 4,561,364, 4,572,084 and 4,597,342 which are hereby incorporated by reference.

Other embodiments of coal-gas mixtures, as well as furnaces having the various features discussed above, will become apparent to a person with ordinary skill in the art from an understanding of this invention. For instance, instead of micronized coal, other additives may be used in the slurry to provide for radiation, enhancement. Graphite particles, carbon black or aluminum powder have been shown to be good radiation enhancers in the 1–5 micron infrared range, but coal has been used as the optimal slurry additive for enhancing a predominantly natural gas flame because it is inexpensive and easy to obtain. No. 6 fuel has been shown to provide good radiation enhancement, but because of its tarry nature, it must be dissolved in No. 2 oil or other solvent to obtain a good micronized coal-oil slurry.

Although the present invention has been discussed and described with primary emphasis on the preferred embodiments, it should be understood that various modifications can be made in the design and operation of the present invention without departing from the spirit and scope thereof. The present embodiments are therefore to be considered in all respects as illustrative and not restrictive, the scope of the invention being indicated by the following claims rather than by the foregoing description, and all changes which come within the meaning and range of equivalency of the claims are therefore to be embraced therein.

What is claimed is:

1. In a method for use in a furnace converted from combustion of oil or coal to natural gas, the improvement comprising co-firing natural gas in said furnace together with a slurry comprising micronized coal in No. 2 fuel oil to enhance the infrared radiation from the natural gas flame.

2. The method according to claim 1 wherein said slurry comprises about 32 to about 60 weight % micronized coal with about 48 to about 68 weight % No. 2 oil.

3. The method according to claim 1 wherein said coal slurry comprises about 35 weight % micronized coal with 65 weight % No. 2 fuel oil to enhance the flame radiance of the natural gas flame in a wavelength of from about 1 micron to about 5 microns.

4. A furnace retrofitted from an oil fired furnace to burn a mixture of a fuel composition and natural gas, said fuel composition comprising an atomized slurry of micronized coal in No. 2 fuel oil, said furnace comprising a radiant energy zone, a convective energy zone and the combination of an atomizer with a burner wherein said burner includes a gas ring having openings for introducing a natural gas jet flame in a circular pattern such that fuel combustion of both the natural gas and the atomized fuel is substantially complete, a ratio of said micronized coal to said No. 2 fuel oil being such that said co-combustion with said natural gas enhances the flame radiance of the natural gas flame in an infrared wavelength range between 1 micron to 10 microns, thereby increasing the amount of energy provided to the radiant energy zone of the furnace and reducing the energy to the convective energy zone.

5. The combination of claim 4, wherein said atomizer further comprises a pintel for shaping the atomized fuel vortex within said natural gas jet flame.

6. The combination of claim 5, wherein said atomizer further comprises a swirler for creating and maintaining the atomized fuel in a vortex within said natural gas jet flame.

* * * * *